United States Patent [19]

Richardson

[11] Patent Number: 4,921,045

[45] Date of Patent: May 1, 1990

[54] SLIP RETENTION MECHANISM FOR SUBTERRANEAN WELL PACKER

[75] Inventor: Downie S. Richardson, Torrance, Calif.

[73] Assignee: Baker Oil Tools, Inc., Orange, Calif.

[21] Appl. No.: 805,882

[22] Filed: Dec. 6, 1985

[51] Int. Cl.[5] ..... E21B 33/129

[52] U.S. Cl. ..... 166/134; 166/136; 166/211; 285/145

[58] Field of Search ..... 166/134, 136, 211, 213, 166/214, 173, 177; 285/145

[56] References Cited

U.S. PATENT DOCUMENTS

| | | | |
|---|---|---|---|
| Re. 31,933 | 7/1985 | Taylor et al. | 166/140 |
| 3,456,723 | 7/1969 | Current et al. | 166/134 |
| 4,436,150 | 3/1984 | Baiker | 166/134 |
| 4,479,538 | 10/1984 | Coyle, Sr. | 166/173 |
| 4,548,625 | 10/1985 | Luke | 166/217 |

*Primary Examiner*—William P. Neuder

*Attorney, Agent, or Firm*—Hubbard, Thurman, Turner & Tucker

[57] ABSTRACT

A slip retention mechanism for a packer or hanger for a subterranean well comprises a slip retention sleeve disposed in surrounding relationship to a tubular body on which cone elements are mounted for axial movement. Segment-shaped slips are mounted in the space intermediate the retention sleeve and the tubular body and have inner surfaces cooperable with the cone elements to effect a radially outward displacement of the slip elements upon relative axial movement of the cone elements. The slip retention sleeve is provided with a plurality of peripherally spaced windows separated by axially extending bars. Each slip segment is provided with an axially extending slot in its outer surface which is aligned with one of the window bars. A leaf spring is mounted intermediate the window bar and the axial slot to exert a radially inwardly directed force on the respective slip segment to hold it in a retracted position. A pair of lateral and radially extending spring projections are formed on the leaf spring to cooperate with lateral slots provided on the exterior of the slip segment to secure the slip segment and spring in their operative positions.

6 Claims, 13 Drawing Sheets

SLIP RETENTION MECHANISM FOR SUBTERRANEAN WELL PACKER

RELATIONSHIP TO OTHER PENDING APPLICATIONS

The disclosure of this application is substantially identical to the disclosure of Ser. No. 806,030 (BP-254); Ser. No. 811,093 (BP-255); and Ser. No. 806,031 (BP-250), filed concurrently herewith and assigned to the same Assignee as this application.

BACKGROUND OF THE INVENTION

1. Field of the Invention

The invention relates to an apparatus for retaining the casing engaging slips of a packer or hanger for a subterranean well in an inoperative position during run-in of the packer or hanger into the well.

2. History of the Prior Art

Packers or hangers are probably the most common element utilized in a subterranean well after the installation of the casing. It is common to employ segment-shaped slip elements having peripherally extending teeth formed on their outer surfaces which are cammed into biting engagement with the inner bore wall of the well conduit within which the packer or hanger is to be anchored. Obviously, in order to insert the packer or hanger in the well conduit at a desired location, it is essential that the slips be maintained in a retracted position so as to move freely through the well conduit during the run-in procedure.

Many forms of slip retention mechanisms have heretofore been employed in prior art devices. Such devices have taken the form of shear screws which hold the slips in a retracted position against a spring bias. Alternately, axially shiftable sleeves have been employed to engage or surround the slips and thus hold them in an inoperative position.

All of the prior art devices have been characterized by not being failsafe. It has always been possible during the run-in of a packer or hanger to encounter an obstruction in the well which will effect a release of the slip retention mechanism and result in the inadvertent setting of the slips prior to the packer or hanger reaching its desired position in the well. The time and expense of releasing and retrieving an inadvertently set packer or hanger is well known to those skilled in the art.

SUMMARY OF THE INVENTION

The invention provides a slip retaining sleeve which is fixedly mounted in surrounding relationship to a tubular body element of a packer or hanger. Vertically spaced cone elements are mounted on the tubular body member and means are provided for effecting a relative axial movement of such cone elements when it is desired to set the slips. The slip retention sleeve is provided with a plurality of peripherally spaced windows separated by axially extending solid bar portions. The slips are preferably formed as arcuate segments and are disposed in the annular space defined between the slip retention sleeve and the tubular body element. The slip segments are provided with camming surface engagable by the cone elements to shift the slips radially outwardly on the occurrence of relative axial movement between the cone elements. Each slip is provided with an axial slot on its periphery which is aligned with one of the solid bar portions defining the windows in the retention sleeve.

The slip retraction and retaining mechanism comprises a leaf spring which is compressibly mounted between the inner surface of each bar portion and the base of the axial slot of the cooperating slip. To prevent the leaf springs from inadvertent release from their compressed positions, each leaf spring is provided with an axially extending tail portion which has a hook formed on its end to cooperate with an appropriate radial surface on the lower cone sleeve to prevent upward displacement of the leaf spring relative to the body retention sleeve during run-in. Additionally, each leaf spring is provided with a pair of opposed radially and peripherally extending probjections which are respectively received in peripheral slots provided in each of the slip elements which communicate with the axially extending slot which receives the main body of the leaf spring. Thus, the leaf springs and slips are firmly secured in cooperative relationship, yet the radial movement of the slips produced by axial movement of the cooperating cone elements is not prevented but is opposed only by the compression of the leaf spring element. So long as the cone elements are not axially shifted, the slips are held in a radially retracted position relative to the retaining sleeve, hence cannot engage the bore wall of the well conduit.

If additional compression force is desired, a second leaf spring element may be mounted in overlying and radially aligned relationship to the primary leaf spring, thus effectively doubling the inwardly directed compressive force exerted on each slip element. The second leaf spring element is provided with a pair of notches on each of its sides to respectively receive the radially and peripherally extending spring projections of the respective primary leaf, thus securing the second leaf spring element in its operative position.

Further objects and advantages of the invention will be readily apparent to those skilled in the art from the following detailed description, taken in conjunction with the annexed sheets of drawings, on which is shown a preferred embodiment of the invention.

BRIEF DESCRIPTION OF THE DRAWINGS

FIGS. 1A, 1B, 1D, 1E, 1F, and 1G are quarter sectional views, while FIG. 1C is a full sectional view.

DESCRIPTION OF THE PREFERRED EMBODIMENT

Figure 1A:
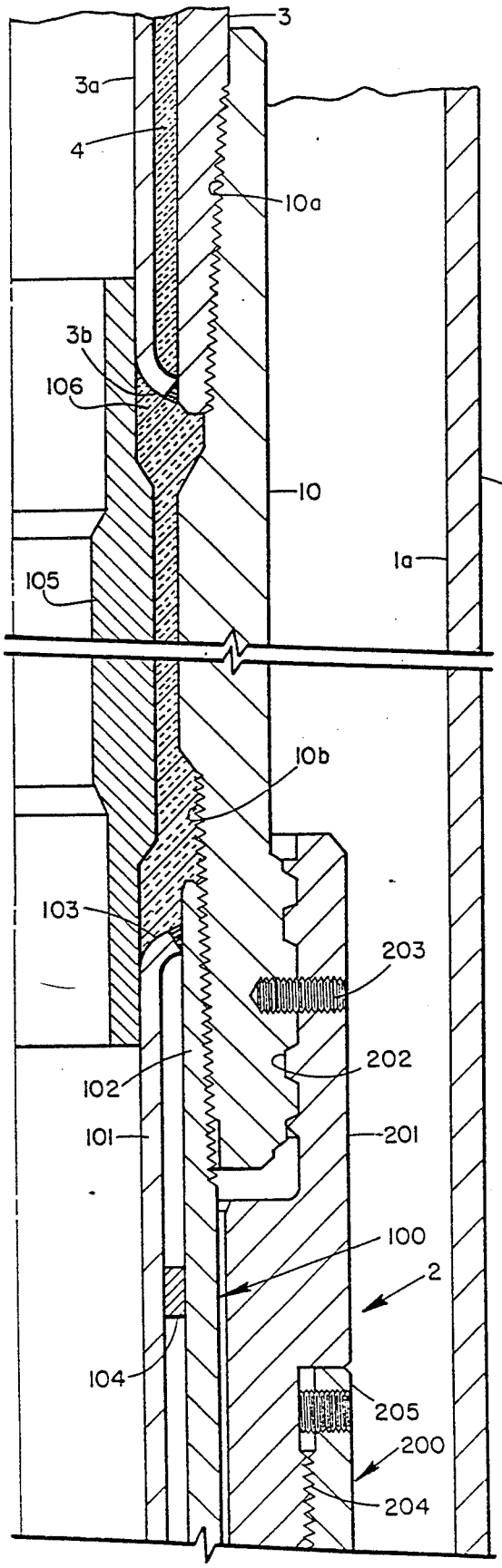
FIGS. 1A, 1B, 1C, 1D, 1E, and 1F collectively represent a vertical sectional view of a packer embodying this invention with the elements thereof shown in their run-in position with respect to a well casing.

Referring to the drawings, a packer 2 embodying this invention comprises the telescopic assembly of a mandrel 100 within an inner tubular body assembly 200, the components of which are all indicated by numbers in the 200 series, which, in turn, is telescopically inserted within an outer operative tubular assembly 300, the elements of which being all indicated by numbers in the 300 series. While packer 2 is designed as a packer for a steam injection operation, the slip retention mechanism of this invention is usable in any type of packer or hanger.

The upper end of the inner tubular body assembly 200 is provided with a sub 201 defining internal left-hand threads 202. Threads 202 are engaged by external threads provided on a connector sub 10 which is provided with internal threads 10*a* at its upper end for connection to the bottom end of an insulated tubing string 3. Tubing string 3 may be fabricated in the manner described in U.S. Pat. No. 4,423,778 with an inner wall 3*a* confining an insulating insert or packing 4. The left-hand threads 202 are secured for run-in and setting purposes by a radially disposed shear screw 203. Connector sub 10 is additionally provided with internal threads 10*b* at its lower portion for connection to the insulated mandrel or slick joint 100 which extends through the entire body of the packer.

Top sub 201 is provided with external threads 204 on its bottom portion which cooperate with internal threads formed on a seal housing sub 205. Seal housing sub 205 is provided at its lower end with internal threads 206 for connection to external threads provided on the top of an elongated tubular body 210.

Sleeve housing 205 is further provided with an elongated internal recess 207 within which is mounted an annular seal assembly 208. Compression force is applied to annular internal seal assembly 208 by a downwardly projecting annular end portion 201*a* formed on the bottom end of the top sub 201. The detailed construction of the internal seal assembly 208 will be described hereinafter, but for the moment it should be noted that it effects a high temperature resistant sealing engagement with the external cylindrical surface of the insulated mandrel 100 and the internal surface of recess 207.

Below the threads 206, the inner tubular body element 210 is provided with an abutment ring assemblage comprising an inner ring 211 mounted in an annular slot 212 formed on the periphery of the inner body element 210. An outer ring 213, preferably formed of an antifriction metal, is secured in surrounding relationship to the inner ring 211 by a plurality of bolts 214.

The bottom face 213*a* of outer ring 213 abuts the top end face 301*a* of an outer tubular body 301. Body 301 is provided with a plurality of peripherally spaced recesses 302 to respectively accommodate conventional drag blocks 315. Drag blocks 315 are mounted for radial movement with respect to the outer body 301. Radially disposed springs 316 impose a constant bias on the drag blocks 315 urging them into frictional engagement with the bore wall 1*a* of the casing 1. A restraining ring 317 is secured by threads 317*a* and set screws 317*b* to the upper end of outer body 301 and limits the radial outward movement of the upper ends of drag blocks 315.

Figure 4:
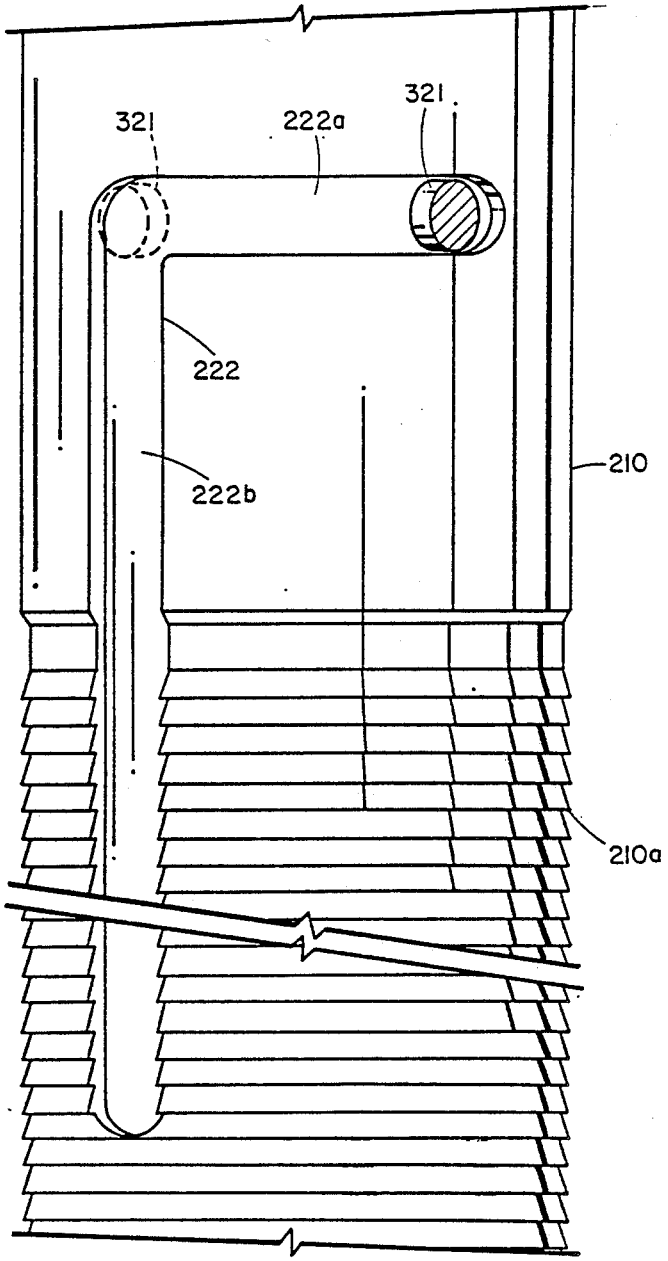
FIG. 4 is an elevational view showing the configuration of the J-slot employed in the packer and the cooperation of such J-slot with a J-pin.

Below the drag block recesses 302, the outer tubular body defines an annular internal recess 303 within which is mounted an annular connector block or ring 320. In order to permit the assemblage of the ring 320 in the annular recess 303, the outer tubular body 301 is split in a generally radial plane as indicated at 301', but this split in no manner affects the operation of the outer tubular body 301. Connector ring 320 defines a mounting for a J-pin 321 which extends into a J-slot 222 provided or the external surface of the inner tubular body 210 (FIG. 4).

On the side of connector ring 320 opposite the J-pin 321, a gap 323 is provided for the mounting therein of a segment-shaped detent 324 for radial movements. A plurality of radially disposed springs 325 urge the detent 324 radially inwardly into engagement with the external surface of the internal tubular body 6. At a location spaced below the position of the detent 324 in the run-in position, a plurality of axially extending ratchet teeth 21O*a* (FIGS. 1C and 4) are provided on the external surface of the internal tubular body 210 and are shaped to cooperate with corresponding teeth 324*a* provided on the detent 224 so as to permit only upward movement of the inner tubular body assembly 200 relative to the outer tubular operative assembly 300.

The lower portion of body element 301 below the radial split 301' defines a downwardly facing external shoulder 301*a* below the location of the detent 324. Shoulder 301*a* provides an abutment surface for the support of an annular cone 304. A plurality of bolts 305 secure cone 304 in the illustrated position of abutment with the shoulder 301*a*.

The lower portion of the outer body sleeve 301 terminates in a thin walled sleeve portion 301*b* which extends downwardly in surrounding relation to the internal body 210 and terminates beneath an annular lower cone 306 which is provided on the upper end of a downwardly extending sleeve 307.

A slip retention sleeve 308 is provided, which, at its upper end, overlies the lower end of the plurality of drag blocks 315. Sleeve 308 is secured to the outer assembly body 301 by internal threads 308*a* and the threads are locked by a set screw 308*b*. Slip retention sleeve 308 thus overlies the upper cone 304 and portions of the lower cone 306 and define an annular space around such cones. A plurality of segment shaped slip elements 310 are mounted within such annular space. Each slip element 310 is provided on its outer arcuate surface with two sets of oppositely directed teeth 310*b* and 310*c* for effecting a biting engagement with the bore wall 1*a* of casing 1. Additionally, an axially extending slot 310*a* is provided on the outer surface of each slip element 310.

The slip retention sleeve 308 is provided with a plurality of peripherally spaced windows 308*a* having solid bar portions disposed intermediate each adjacent pair of windows. The bar portions 308*b* respectively overlie the axial slots 310*c* provided on the slip segments 310.

Figure 1B:
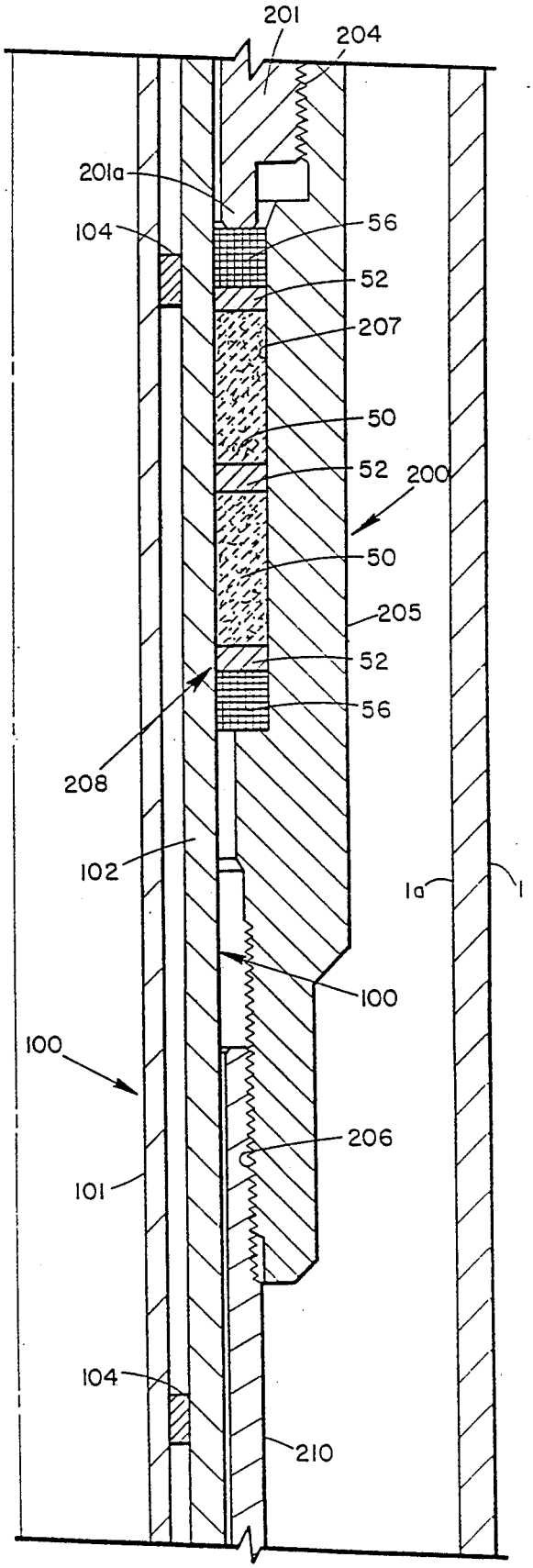
Figure 1C:
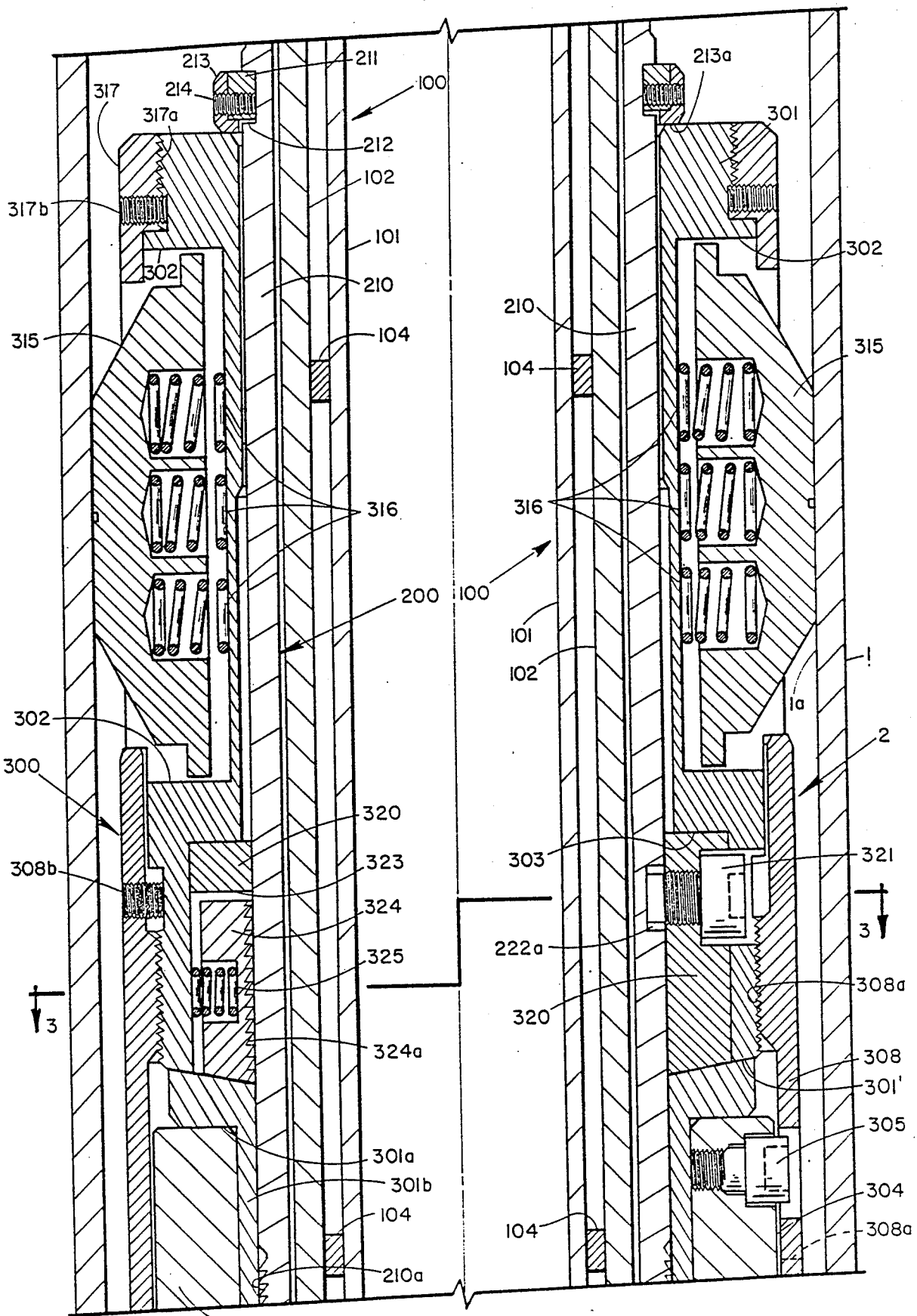
Figure 1D:
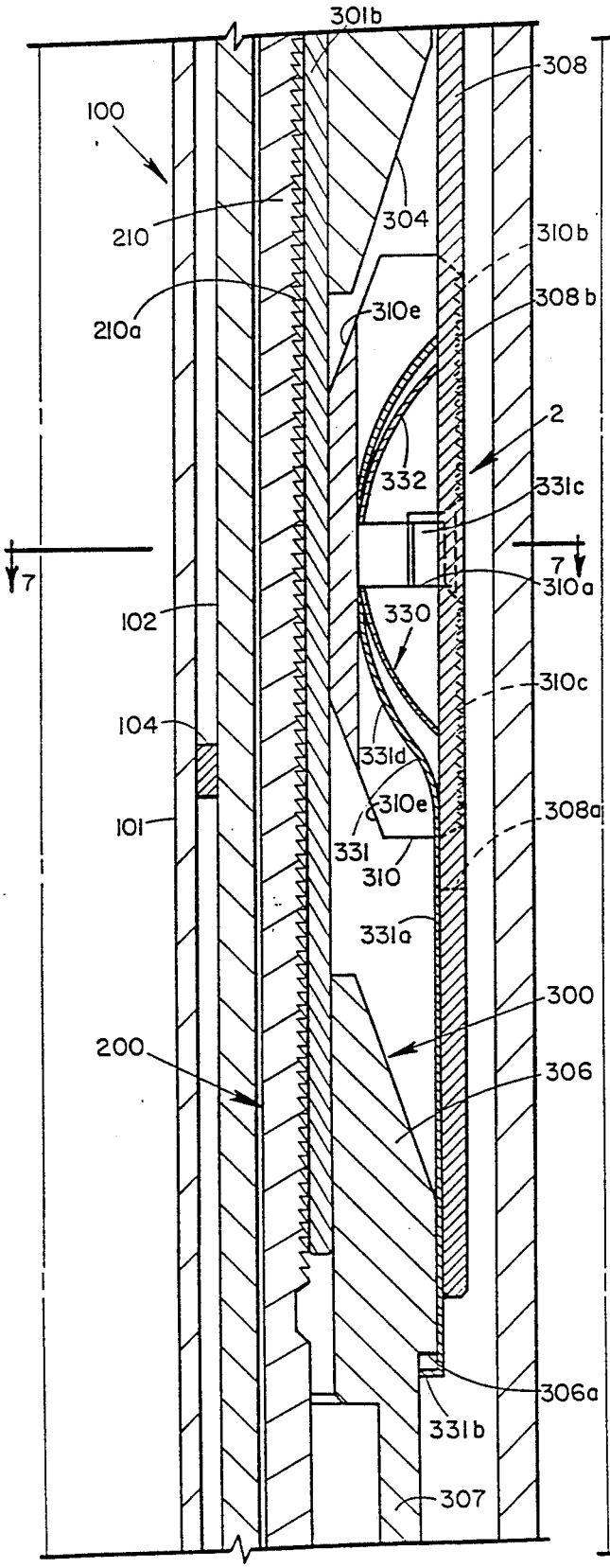

In accordance with this invention, the slip segments 310 are biased to their radially inward position shown in FIG. 1D by a spring assembly 330. Each spring assembly 330 is actually a combination of two leaf springs 331 and 332. The main leaf spring 331 is provided with an elongated tail portion 331*a* which is positioned between the retention sleeve 308 and the outermost surface of the lower cone 306. The end 331*b* of tail portion 331*a* is bent downwardly to engage a downwardly facing shoulder 306*a* formed on the lower cone 306. Thus, upward movement of the main leaf spring 331 is prevented during run-in so long as the lower cone 306 is anchored against axial movement, which it is, in a manner to be later described.

Additionally, the main leaf spring 331 is provided with a pair of lateral spring projections 331*c* which respectively engage transverse slots 310*d* provided in the respective slip 310. Thus each slip 310 is effectively anchored against upward axial movement during run-in by the respective main leaf spring 331. Additionally, the compression of the bowed portion 331*c* of the main leaf spring 331 imposes a radially inward bias on each of the slip segments 310 to secure them in a retracted position.

If additional inward biasing force is required, the second leaf spring 332 is inserted in the assembly in overlying and radially aligned relationship to the main leaf spring 331. Second leaf spring 332 is provided with edge notches 332*a* adjacent its central portion to respectively accommodate the lateral spring projections 331*c* of the main leaf spring 331 and secure the respective spring in the position illustrated in FIG. 8. Slips 310 are otherwise of conventional configuration and are provided with upper and lower sets of transverse teeth 310*b* and 310*c* to bite into the casing bore surface 1*a* and prevent axial movements of the packer when the slips are set.

The lower end of the internal body 210 of the internal body assembly 200 is of increased radial thickness as shown at 210*b* (FIG. 1E), and provides support for the lower end of the sleeve portion 307 of the lower cone 306. An annular abutment block 335 is secured by internal threads 335*a* to the lower end of sleeve portion 307 and, in such secured position, effects a clamping of a spiral lock ring 334 between the upwardly facing surface 335*b* of the abutment block 335 and the bottom end surface of the sleeve portion 307 of the lower cone 306. Spiral lock ring 334 also abuts against a downwardly facing shoulder 210*c* formed on the exterior of the internal tubular body 210. A set of shear screws 333 traverse block 335, the sleeve portion 307, and engage an annular groove 210*d* formed on inner body 210.

An outer packing assemblage 340 is mounted on the cylindrical periphery of the lower sleeve portion 210*b* of the inner tubular body assemblage 200. The packing assemblage 340 will be described in detail hereinafter. At the lower end of the packing assemblage 340, an abutment sleeve 344 is provided which is threadably secured to the upper end of a force-transmitting sleeve 346 by threads 345. The lower end 346*a* of the force-transmitting sleeve 346 is of inwardly increased radial thickness to rest against a slightly enlarged cylindrical surface 240*a* provided on an extension sleeve 240 of the inner tubular body assembly 200. A set of shear screws 347 secure the bottom end of force-transmitting sleeve 346 to extension sleeve 240 for run-in purposes.

The bottom end of the inner tubular body 210 is formed with a plurality of peripherally spaced collet arms 210*f* having enlarged head portions 210*g*. The collet head portions 210*g* are held by surface 240*a* of extension sleeve 240 in engagement with an internal annular latching recess 346*b* formed in the force-transmitting sleeve 346.

The top end of the extension sleeve 240 is provided with peripherally spaced notches 240*c* to mount a correspondingly shaped spider element 242 having peripherally spaced ridges 242*a* which project radially between the collet arms 210*f* and thus key the extension sleeve 240 to the tubular body 210 for co-rotation. Additionally, the extreme upper end surface 240*d* of the extension sleeve 240 is axially spaced from a downwardly facing surface 210*h* which is located at the beginning of the collet arms 210*f*, so that upward movement of the extension sleeve 240 will produce an upward displacement of the inner tubular body assemblage 200.

Below the location of the enlarged collet heads 210*g*, an annular recess 240*k* is formed in the periphery of extension sleeve 240 to permit the collet heads 210*g* to be cammed inwardly and thus release their engagement with the force transmitting sleeve 346. This action is required to effect the removal of the packer from the well bore after the packer has been set. An abutment ring 245 is secured to the bottom end of the extension sleeve 240 by a plurality of peripherally spaced bolts 246. Abutment ring 245 will engage the bottom end of the force-transmitting sleeve 346 when the entire packer unit 2 is to be removed from the well bore.

It was previously mentioned that the entire packer 2 is traversed by a tubular mandrel 100 which has a cylindrical exterior surface in sealing engagement with the internal seal assembly 208 provided in the upper portions of the inner tubular body assembly 200. While not necessary for the operation of the described apparatus as a packer, when utilizing the packer for the injection of steam into a well, it has been found highly desirable to form the mandrel 100 in a double-walled configuration. Thus, an inner wall 101 is provided in spaced relationship to the outer wall 102 and welded thereto at the ends by out-turned wall portions 103 (FIG. 1A). Spacer ribs 104 may be provided on inner wall 101 at axially spaced intervals. Insulation may be provided between the inner and outer walls 101 and 102 or the space between such walls may be evacuated. In any event, the resistance to heat transfer through the walls of the mandrel 100 is substantially increased. Additionally, an inner sleeve 105 may be suitably mounted to confine the space between the upper curved end 103 of mandrel well 101 and the bottom curved end 3*b* of inner wall 3*a* of the insulated tubing string 3. An insulating insert or packing 106 is inserted in the space defined between sleeve 105 and the inner wall 10*c* of connector sub 10.

Figure 5A:
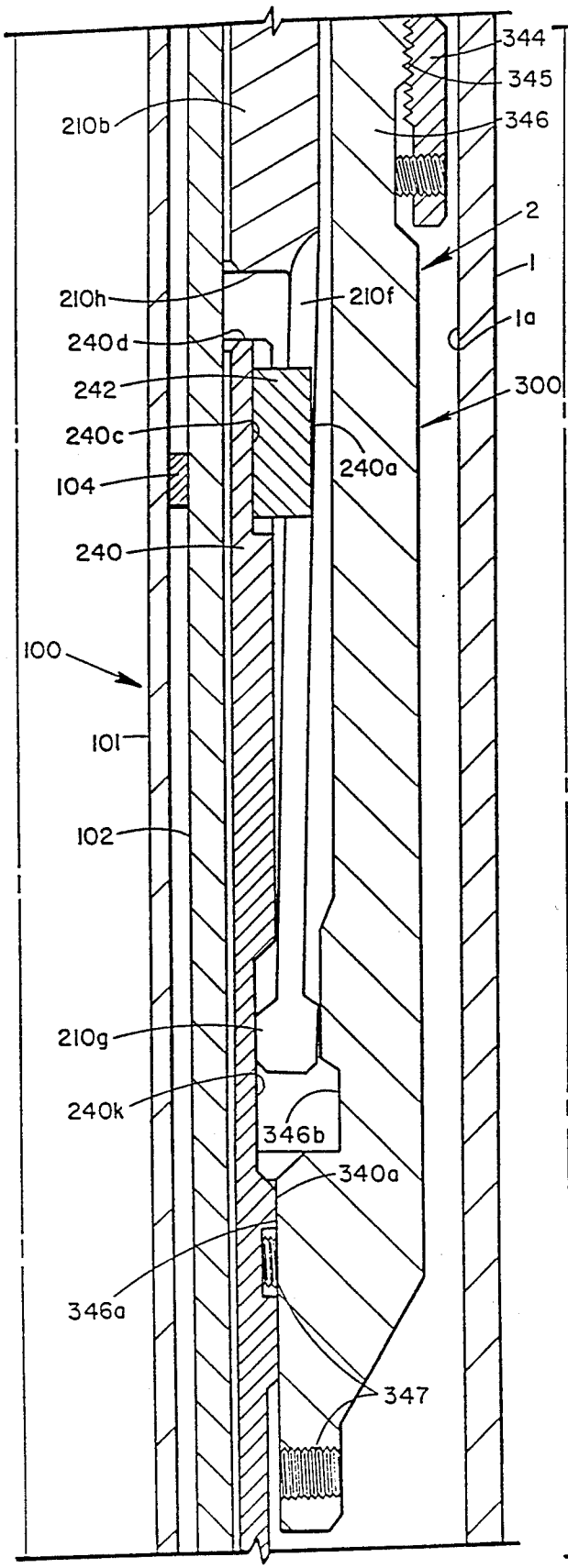
FIGS. 5A and 5B are views similar to FIGS. 1F and 1G, but illustrating the release of the connecting mechanism between the inner tubular body assembly and the outer operative tubular assembly by axial upward movement of the tubing string.
Figure 5B:
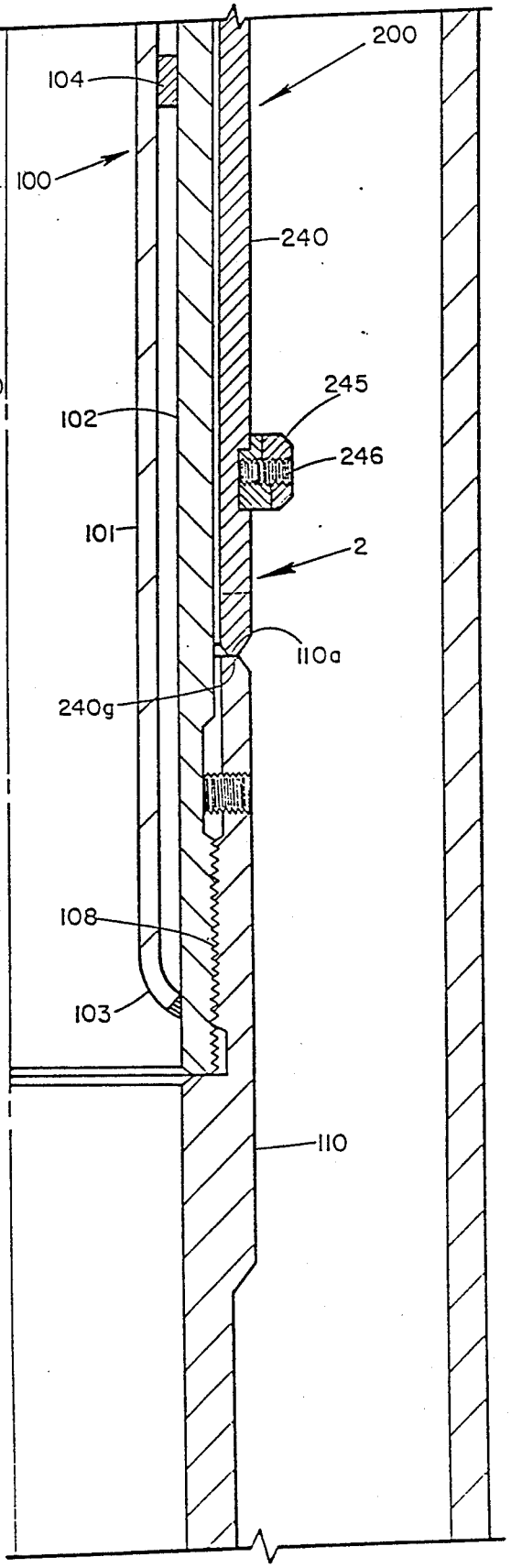
Figure 6:
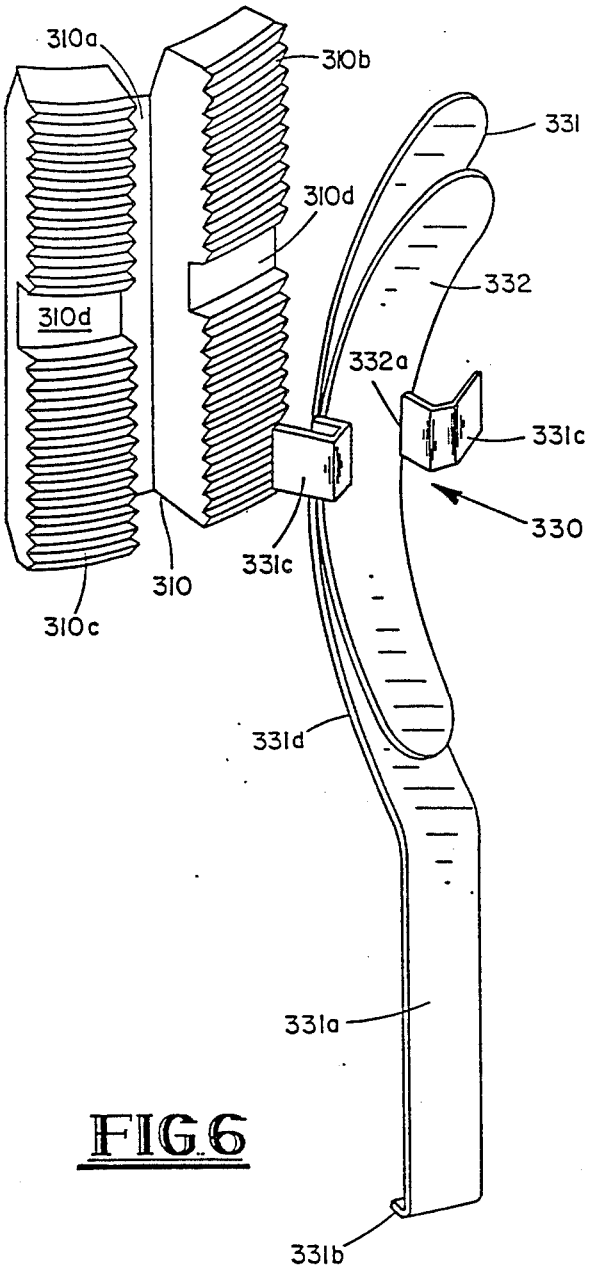
FIG. 6 is a perspective view of the slips and the retention springs therefor.
Figure 7:
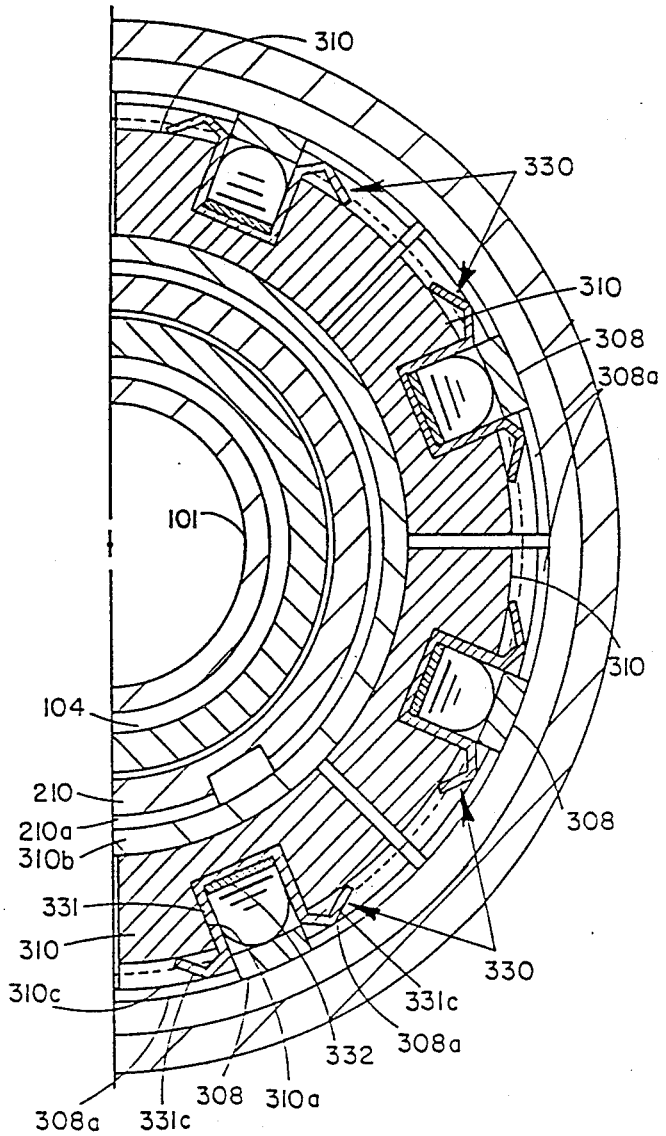
FIG. 7 is a sectional view taken on the plane 7—7 of FIG. 1D.

The bottom end of mandrel 100 is connected by threads 108 to a bottom connecting sub 110 for effecting a connection to an additional length of tubing or directly to a screen element permitting the in-flow of production fluid into the bore of the insulated mandrel 100 and the out flow of steam to heat the formation. It will be noted that the bottom connecting sub 110 is provided with an upwardly facing end surface 110*a* which is sized so as to effect an abutting engagement with the bottom surface 240*g* of the extension sleeve 240, as shown in FIG. 5B, to effect the release of the inner tubular assemblage 200 from the outer tubular assemblage 300 by upward movement of mandrel 100, and thus permit the relaxation of any axial force applied to the packing element 340 and the upper and lower cones so as to permit release of the slip elements 310 from engagement with the casing wall 1*a*.

Figure 8:
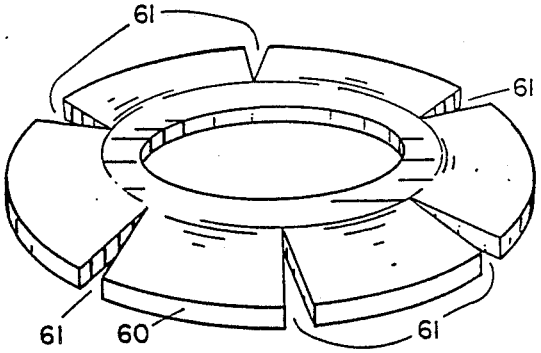
FIG. 8 is a perspective view of one of the discs forming the elements of the outer packing.
Figure 10:
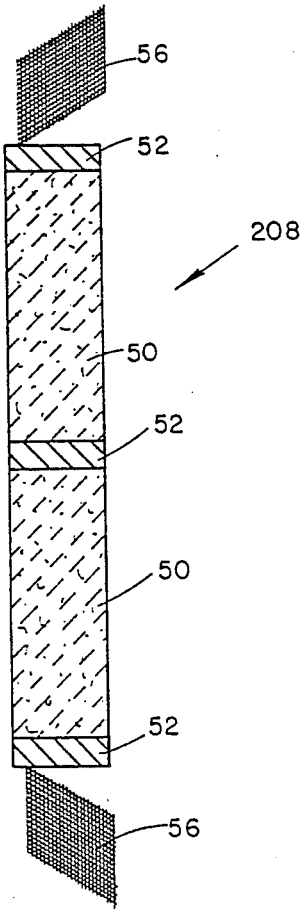
FIG. 10 is a sectional view of the inner packing assembly prior to application of compressive force thereto.

Referring now to FIGS. 1B and 10, the detailed configuration of the inner packing element 208 will now be described. As illustrated in FIG. 8, the packing element 208 comprises a plurality of die-formed rings 50 which are formed primarily of graphite and a minor quantity of ash. For example, the material utilized in the rings 80 may comprise 80% graphite and 20% carbon oxide ash, which is then die-formed into the ring configuration in which it is employed in the internal packing element 208. Such material is sold under the trademark "Grafoil" by Carbon Products Division of Union Carbide Corporation. Each ring of die-formed "Grafoil" is abutted on both axial ends by a relatively ductile annular spacer 52. For example, ductile cast iron may be employed as the spacer. Adjacent each axial end of the entire assemblage, a force-transmitting ring element 56 is provided, which is preferably die-formed as a non-rectangular parallelogram (FIG. 8) from a relatively soft metal wire mesh. For example, a wire mesh comprising essentially 100% nickel would be satisfactory. When the inner packing element 208 is assembled in the inner tubular body assemblage 200, (FIG. 1B) its force-transmitting end elements 56 are deformed from their non-perpendicular parallelogram position into their rectangular parallelogram configuration illustrated in FIG. 1B by the axial force transmitted to the inner packing assemblage 208 by the threading of the upper sub 201 into the seal housing sleeve 205. Sufficient axial force is applied to the assemblage to cause a non-elastic radial deformation of all of the individual elements of the assemblage and thus the "Grafoil" rings are expanded into intimate sealing engagement between the inner surface 207*a* of the packing housing sub 205 and the outer cylindrical surface of the mandrel 100. At the same time, deformation of the end elements 56 will move these elements into close proximity to the same surfaces and thus minimize the opportunity for extrusion of the "Grafoil" rings 50 into the unsealed space defined between the end elements and the adjoining metallic surfaces. A packing element of this configuration has been found to be extremely effective at temperatures of 700° F. and corresponding steam pressures on the order of 2,500 psi.

Figure 1E:
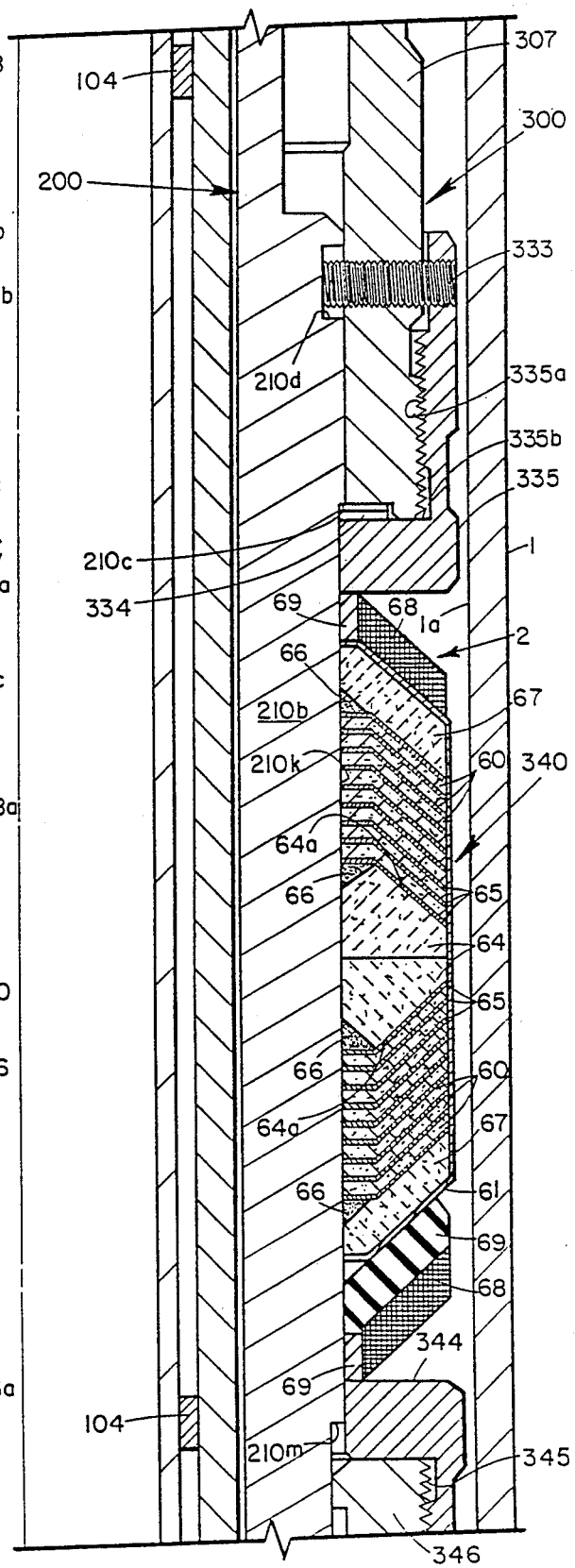
Figure 1F:
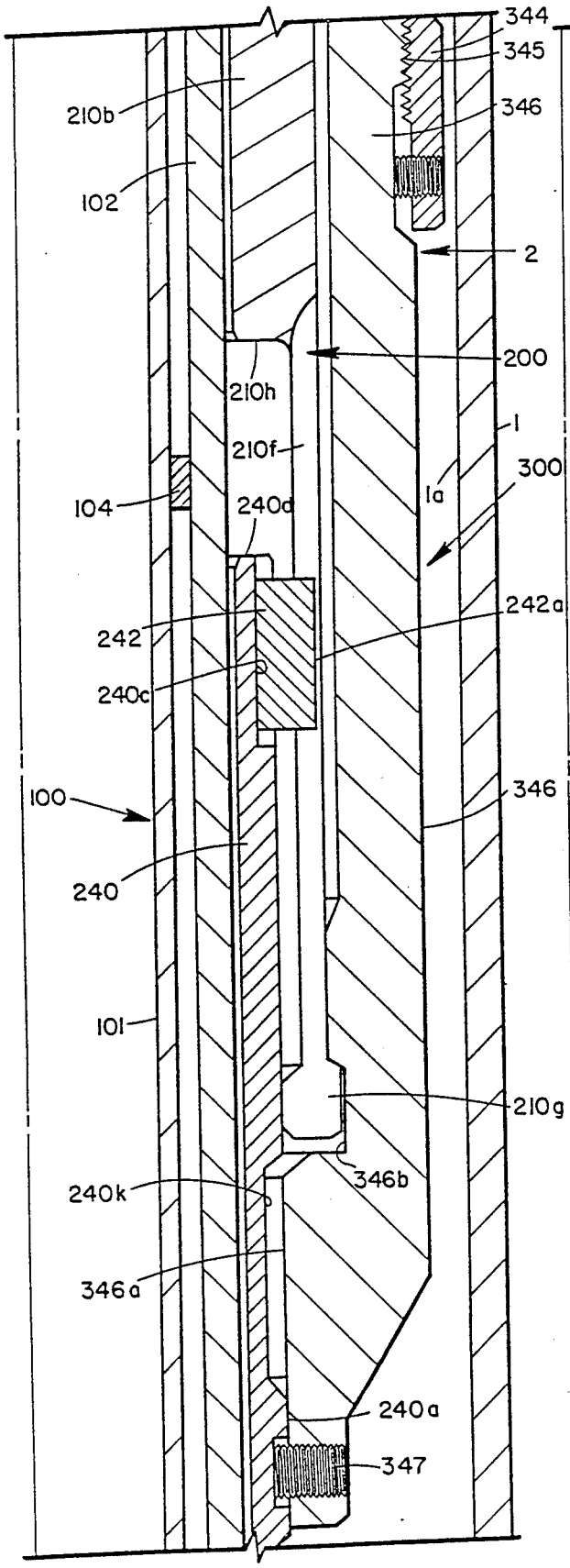
Figure 1G:
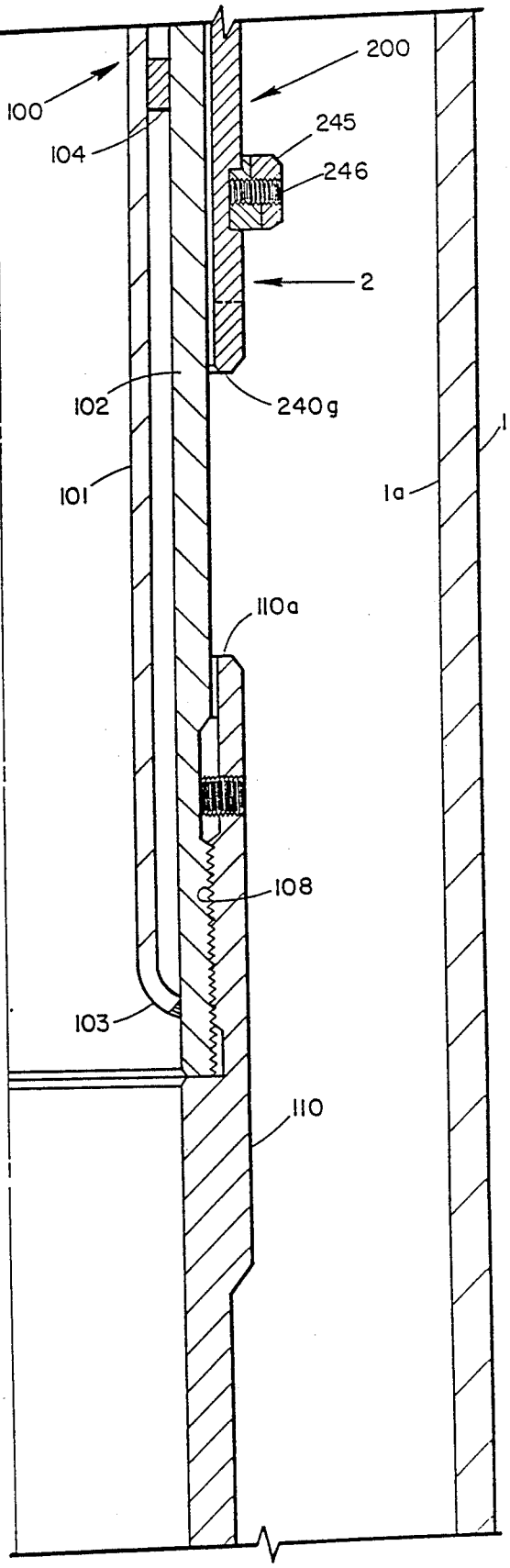
Figure 9:
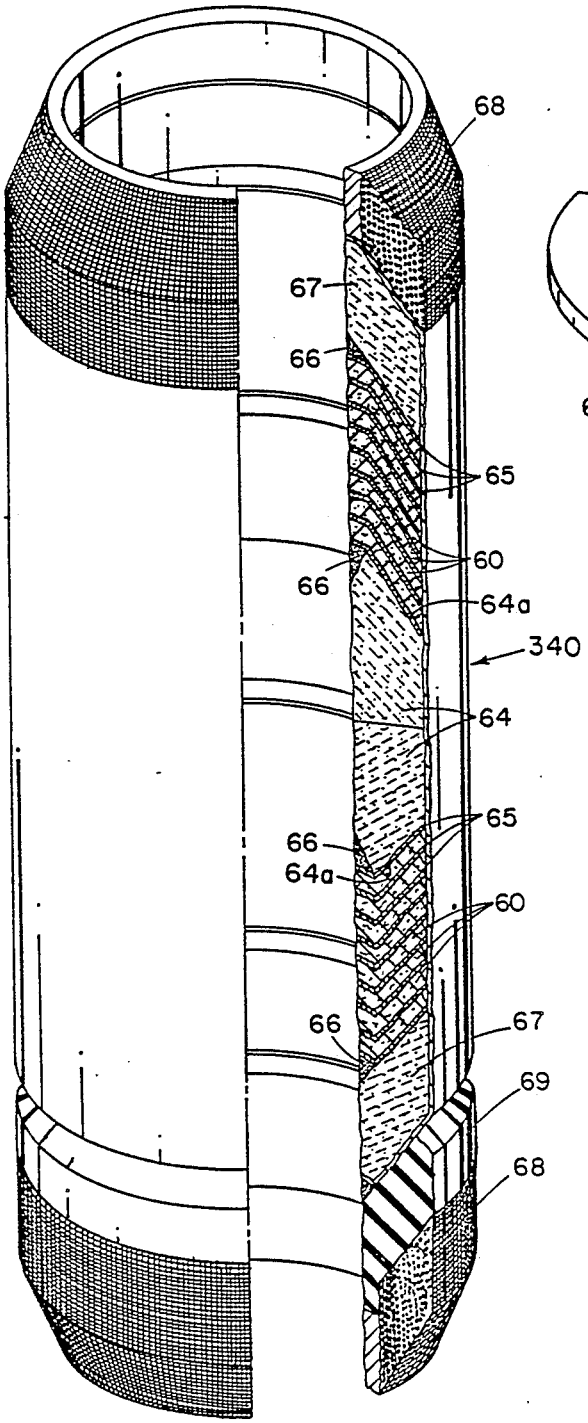
FIG. 9 is a perspective view of the assembled outer packing.

The outer packing assembly 340 is similarly formed in a unique manner. Referring to FIGS. 1E, 8, and 9, the outer packing 340 comprises at least two axially stacked sets of discs or petals 60. Each disc 60 is formed from metallic wire netting 60*a* (FIG. 8) impregnated with "Graphoil" material. Each disc is then formed with a plurality of peripherally spaced slots or notches 61 as best shown in FIG. 8. The discs 60 are then die-formed into the angular cross sectional configuration illustrated in FIGS. 1E and 9 wherein the external diameters of the discs 60 are reduced with the corresponding closing of the slots 61. It will be noted that slots 61 in one disc are angularly spaced from the slots 61 in the adjoining discs. Moreover, in the die-forming operation, a ring of metallic wire netting 65, which may be formed from stainless steel or Inconel material, is placed intermediate each of the "Grafoil" discs. The die-forming operation thereafter integrally incorporates the wire netting discs into the "Grafoil" discs and provides a greatly reinforced sealing element.

Two stacks of die-formed, angularly shaped discs 60 are then placed adjacent to annular die-formed rings 64 of graphite yarn reinforced by wire. The radially outer surfaces 64*a* of the die-formed graphite yarn are shaped to respectively conform to the inclined surface portions 60*a* of the "Grafoil" discs 60. The inner portions of rings 64 are sloped away from the relatively radial inner portions of the "Grafoil" discs 60 to accommodate triangularly shaped rings 66 of die-formed "Grafoil". Similar rings 66 are provided adjacent the axially outer radial surfaces of the two stacks of die-formed "Grafoil" discs 60. Axial forces are then transmitted to this assemblage through a die-formed ring 67 of graphite fiber and wire and, adjacent the outer ends of the rings 67, a non-perpendicular parallelogram ring 68 of die-formed chemical resistant metallic mesh is provided. Materials such as #304 stainless steel or Inconel are suitable for the formation of rings 68. Each of the rings 68 rests upon a metallic support sleeve 69.

Figure 2A:
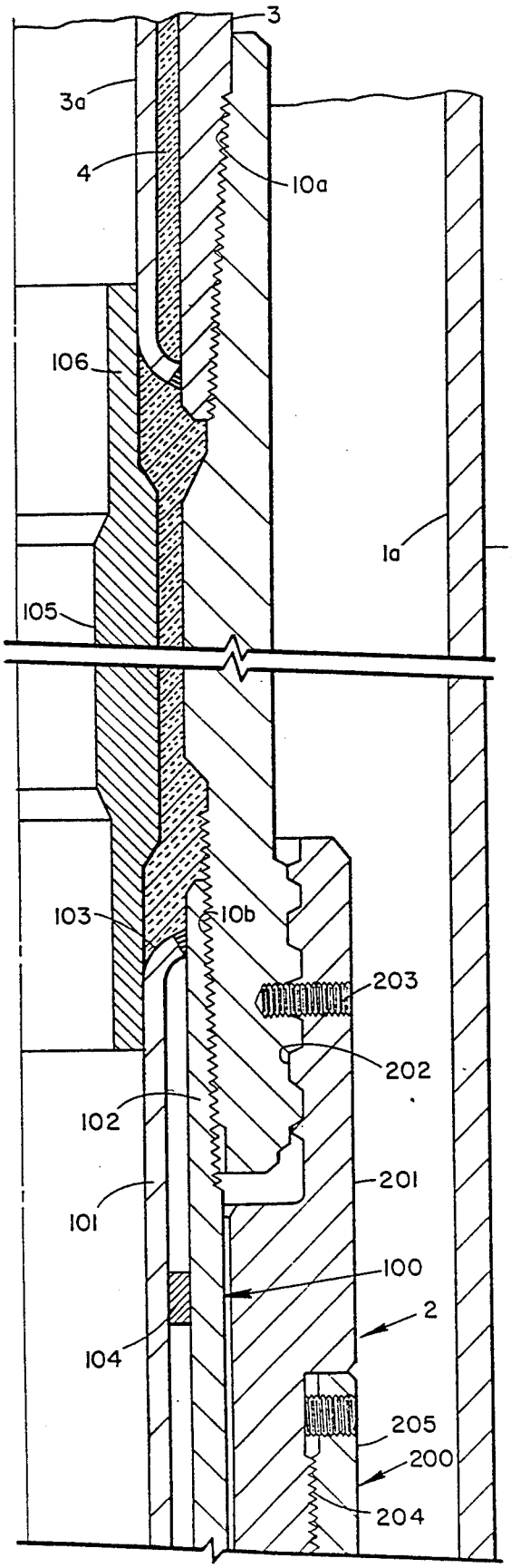
FIGS. 2A, 2B, 2C, 2D, 2E, 2F and 2G are respectively views similar to FIGS. 1A, 1B, 1C, 1D, 1E, 1F, and 1G but showing the elements of the packer in their set position.
Figure 2B:
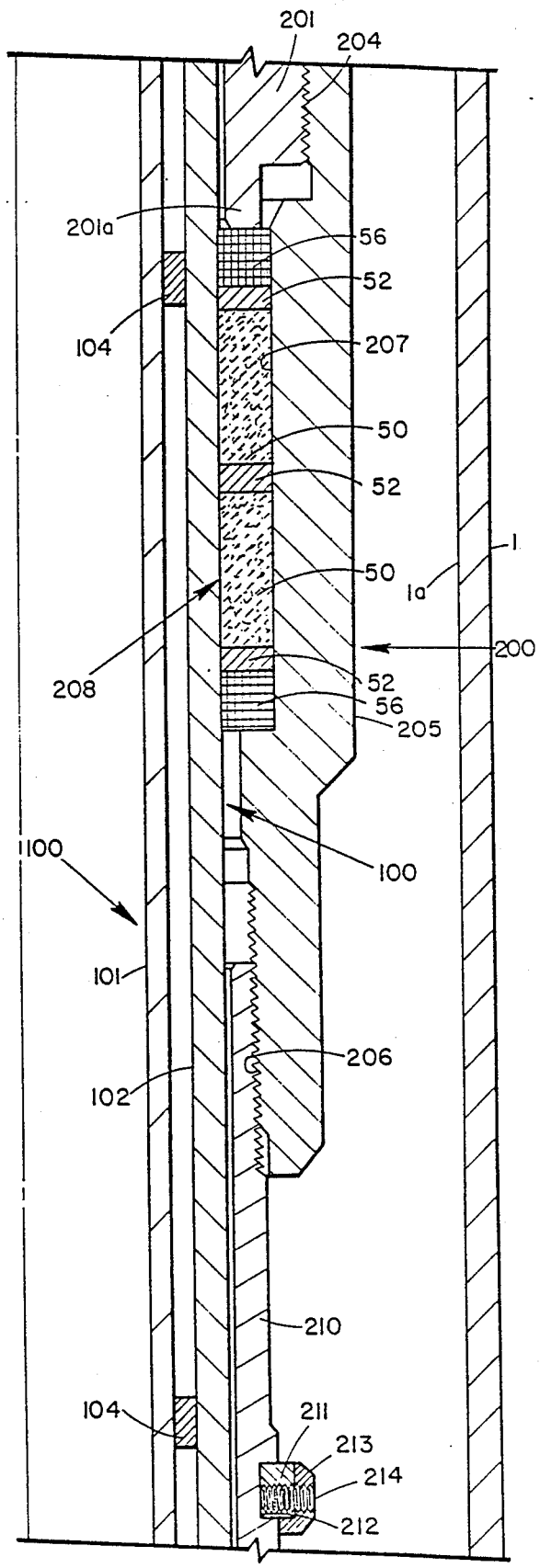
Figure 2C:
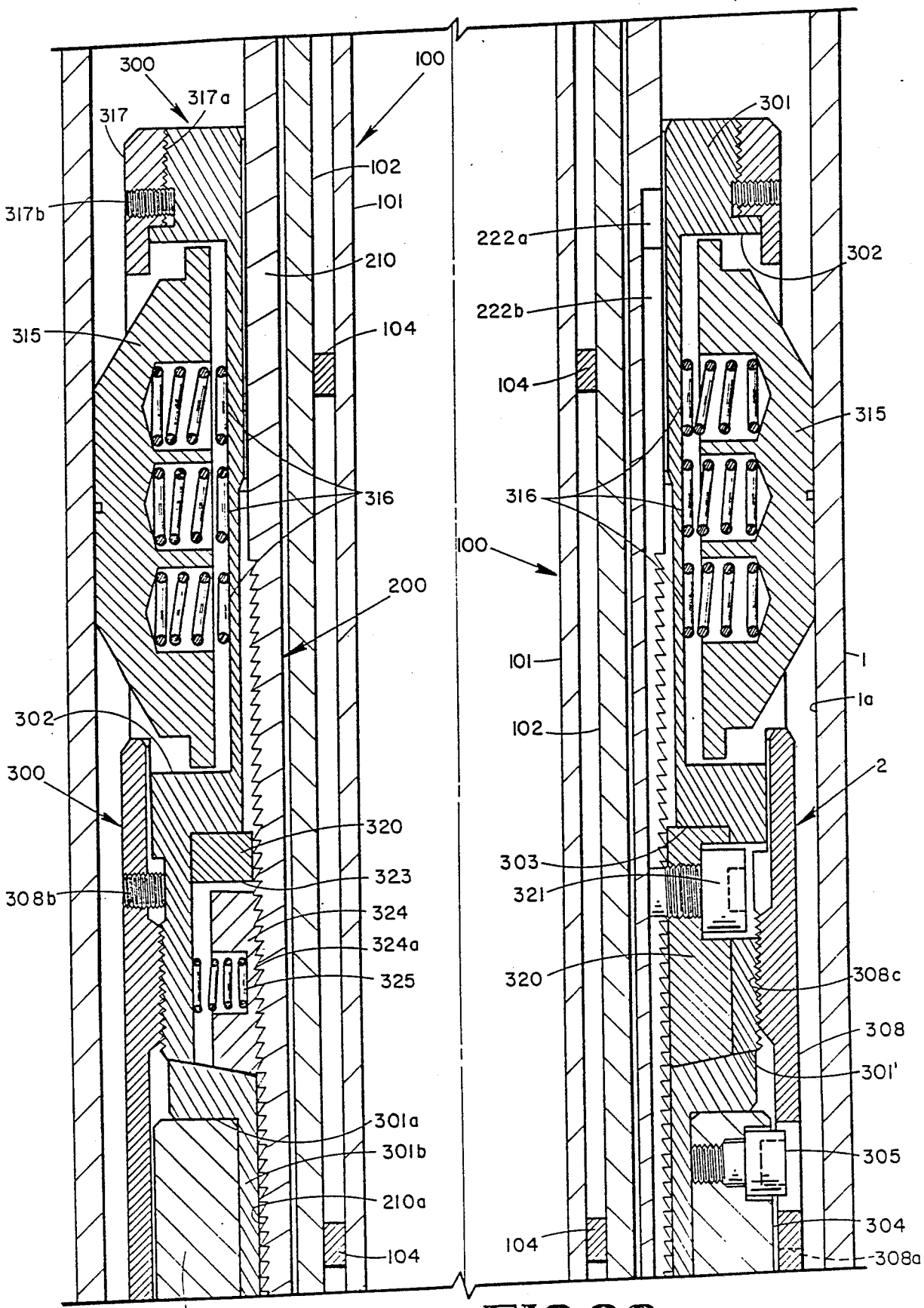
Figure 2D:
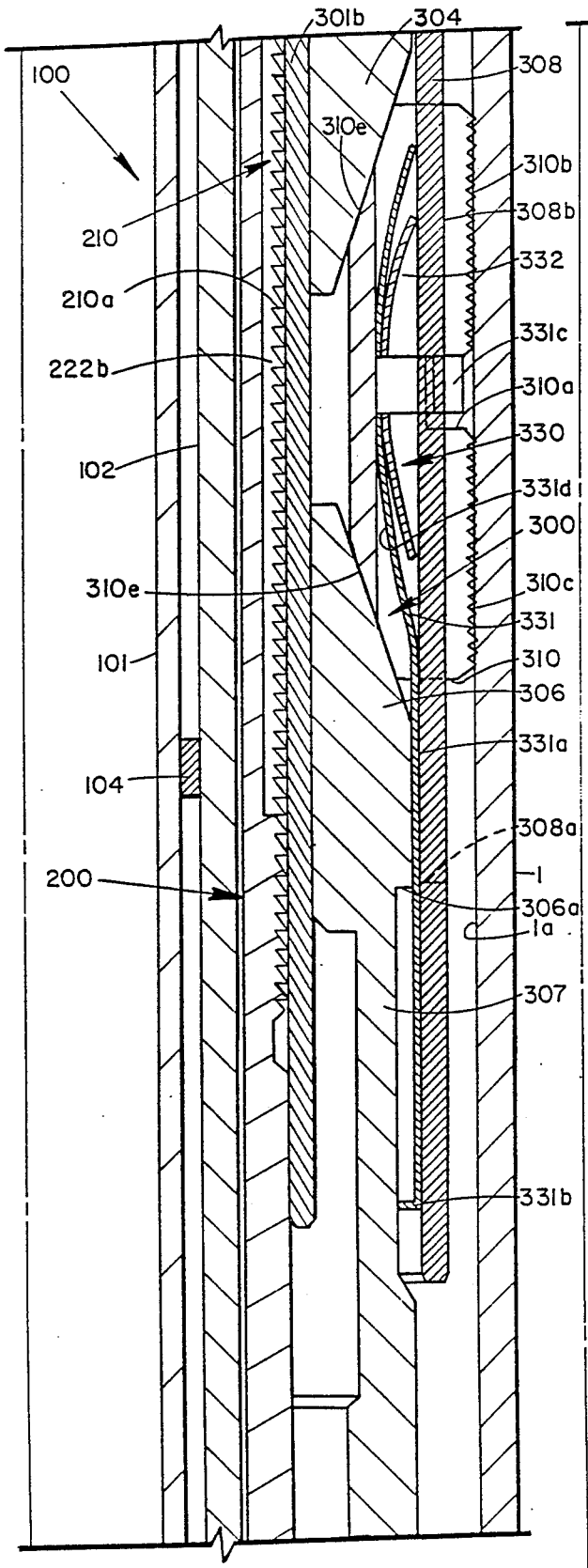
Figure 2E:
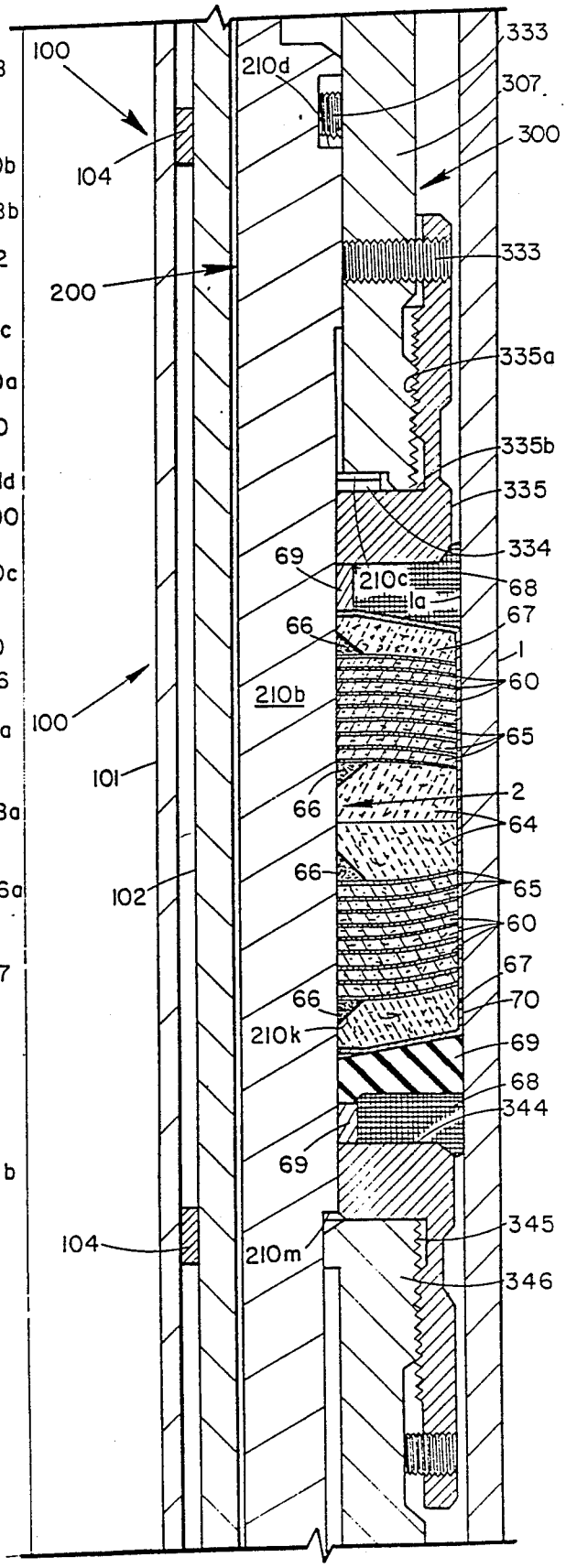
Figure 2F:
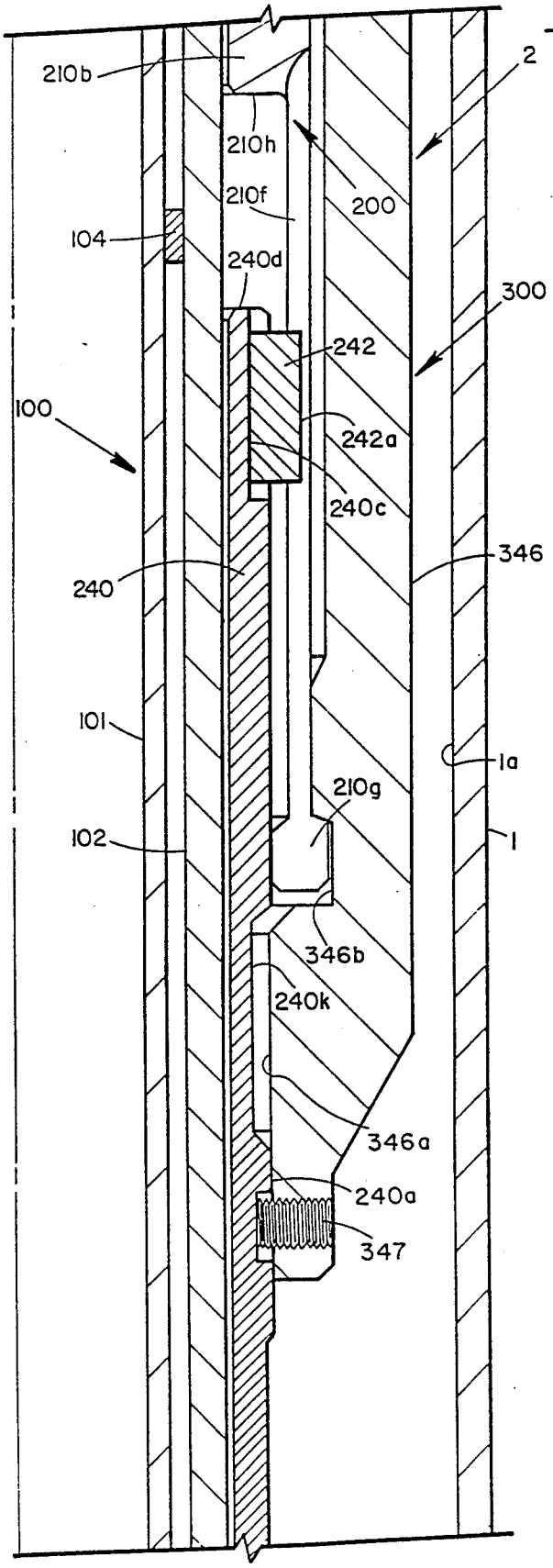
Figure 2G:
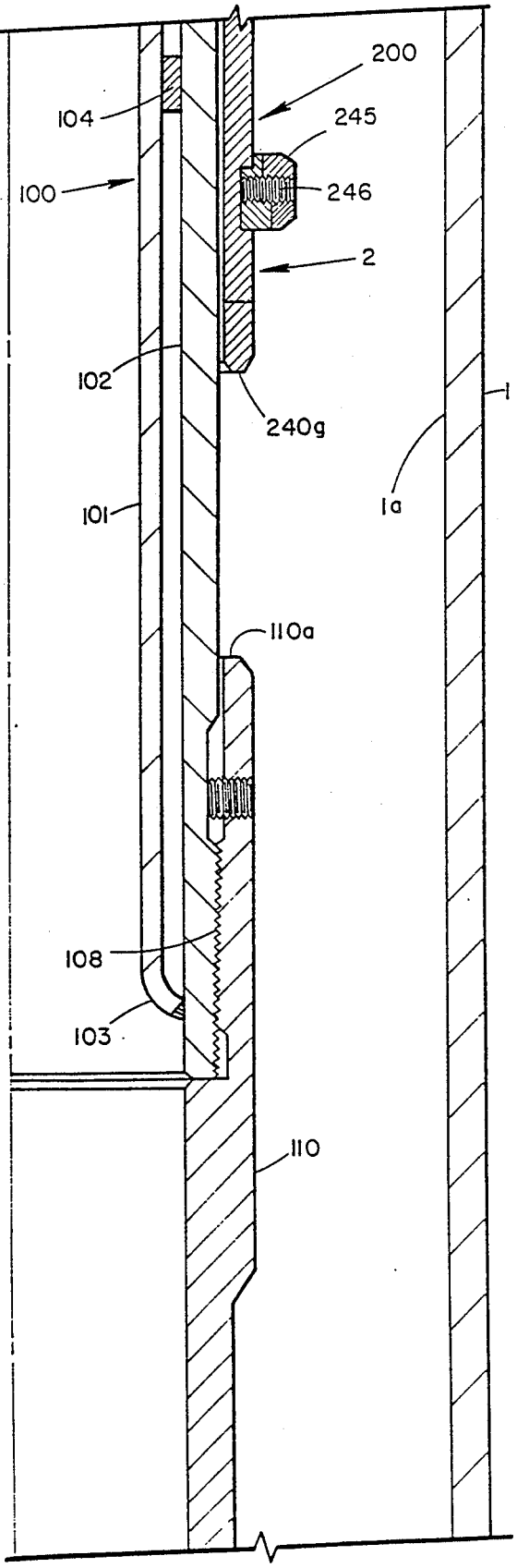
Figure 3:
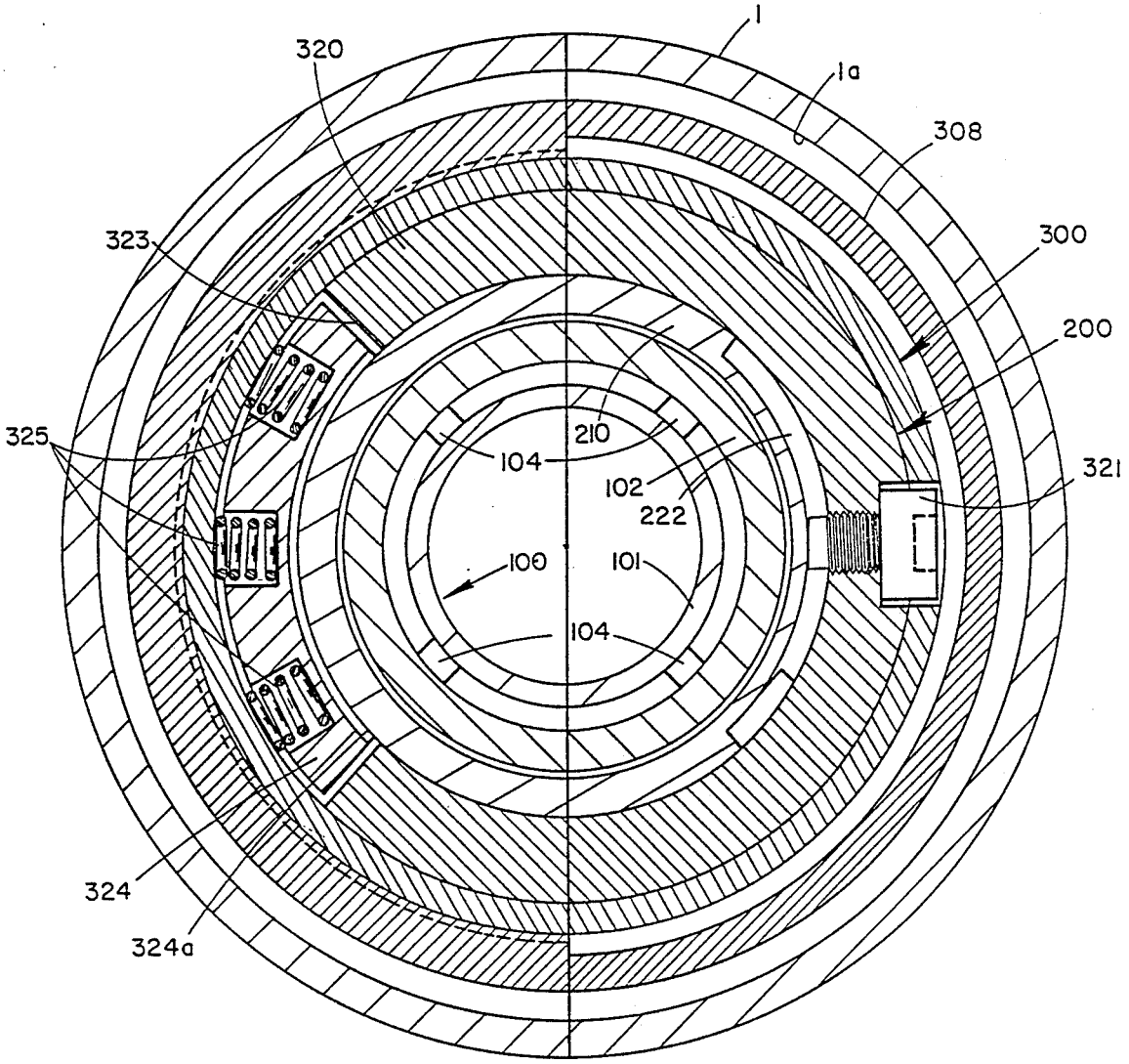
FIG. 3 is a sectional view taken on the plane 3—3 of FIG. 1.

The outer packing assemblage 340 is inserted in the outer tubular assembly 300 in this configuration as shown in FIG. 1E. The application of an axial compressive force to the packing assemblage 340 will have the effect of deforming the assemblage 340 to assume the shape illustrated in FIG. 2E wherein the angularly deformed stacks of graphite discs are caused to assume an almost radial configuration, thus substantially increasing their outer diameters and producing a snug seal against the internal surface of the casing bore 1*a* and the external surface 210*k* of the inner tubular body 210. Moreover, the corresponding deformation of the metallic mesh rings 68 reduces the space for extrusion of the seal material and, hence, prevents degradation of the packing element under sustained high pressures.

If desired, a ring 69 formed of a normal sealing rubber or elastomer and having a non-perpendicular parallelogram cross section, may be incorporated in one axial end of the outer packing assemblage 340. This ring will assist in achieving an initial seal of the packing when the steam is initially introduced into the well and the resulting pressure on the packing element is not sufficient to completely deform it to its maximum sealing position. The rubber or elastomeric seal element 69 will, of course, degrade and disappear as it is exposed to the maximum temperature steam for an extended period, but his will not effect the effectiveness of the remainder of the packing element, because the steam pressure force is always continuously exerted on the packing assembly in a direction to maintain an axial compression force thereon.

Additionally, it may be desirable to encase all of the elements 60, 65, and 67 within a lead or lead antimony sheath 70 so as to protect such elements from injury during the run-in operation. The lead will, of course, melt and disappear as the temperature rises above its melting point due to the introduction of steam into the well.

OPERATION

A detailed description of the operation of the entire packer appears in the above-identified, related pending applications, hence will not be repeated in this application. The operation of the slip retention mechanism is believed to be obvious from the previous description thereof. The leaf spring assembly 330 not only effects the maintainence of a radially inward bias on the slip elements 310 but also secures such slip elements against inadvertent axial displacement relative to the upper cone 304 during the run-in of the packer into the well conduit. Thus, during such run-in, the slip elements remain in a radially inwardly retracted position within the sleeve retention housing 308 and are maintained in such position until the lower cone element 306 is moved upwardly toward the upper cone 304 to engage the inclined bottom surfaces 310*e* of the slip elements 310 (FIG. 2D) and effect the radially outward displacement of such slip elements into biting engagement with the bore wall 1*a* of the casing 1.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a well packer having a tubular body and a cone element mounted on said body for axial movement, the improvement comprising a slip retention sleeve surrounding the path of axial movement of said cone element and defining an annular space around said body, a plurality of segment-shaped slips insertable in said annular space and radially shiftable outwardly by axial movement of said cone element; each said slip having an axially extending slot in its outer surface; said retention sleeve having a plurality of peripherally spaced windows formed therein and separated by axially extending bar portions; said slots being respectively aligned with said bar portions; a plurality of elongated leaf springs respectively mounted between said solid bar portions and said axial slots in said slips for engaging axially spaced regions of said slips to bias said slips radially inwardly, and each said leaf spring having an axially extending tail portion and hook means on the end of each tail portion engaging said cone element to anchor said leaf spring against axial movement in one direction relative to said cone, thereby preventing inadvertent setting of the packer during run-in.

2. The apparatus of claim 1 wherein said leaf spring has a pair of integral lateral spring projections extending radially and peripherally relative to the respective slip; each said slip having periperally extending slots respectively receiving said spring projections therein to secure said leaf spring to said slips.

3. The apparatus of claim 2 further comprising second leaf springs disposed in overlying aligned relationship to said first mentioned leaf springs and having lateral notches to respectively receive said lateral spring projections therein.

4. In a well packer having a tubular body and axially spaced upper and lower cone elements mounted on said tubular body for relative axial movement, the improvement comprising a slip retention sleeve surrounding both of said cones and defining an annular space around said body, a plurality of segment-shaped slips insertable in said annular space and cooperable with both said cones to be displaced radially outwardly by said relative axial extending slot in its outer surface, said slip retention sleeve having a plurality of peripherally spaced windows formed therein and separated by axially extending bar portions; and slips being radially movable to project through said windows with said axially extending slots being respectively aligned with said bar portions; a plurality of leaf springs respectively mounted between said bar portions and said axial slots in said slips for biasing said slips radially inwardly; and each said leaf spring having an axially extending tail portion and hook means on the end of said tail portion engaging said lower cone element to anchor said leaf spring against upward axial movement relative to said lower cone element, thereby preventing inadvertent setting of the packer during run-in.

5. The apparatus of claim 4, wherein said leaf spring has a pair of integral lateral spring projections extending radially and peripherally relative to the respective slip; each said slip having peripherally extending slots respectively receiving said spring projections therein to secure said leaf spring to said slips.

6. The apparatus of claim 5 further comprising second leaf springs disposed in overlying relationship to said first mentioned leaf springs and respectively having lateral notches to receive said lateral spring projections therein.

* * * * *